US007883380B2

(12) United States Patent
Gardner et al.

(10) Patent No.: US 7,883,380 B2
(45) Date of Patent: Feb. 8, 2011

(54) WIRE COUPLING DEVICE WITH A CAM ACTUATED BY A LEVER

(75) Inventors: Michael J. Gardner, Hudson, OH (US); Glenn A. Baker, Cleveland, OH (US)

(73) Assignee: Halex Co./a Scott-Fetzer Company, Cleveland, OH (US)

( * ) Notice: Subject to any disclaimer, the term of this patent is extended or adjusted under 35 U.S.C. 154(b) by 0 days.

(21) Appl. No.: 12/760,364

(22) Filed: Apr. 14, 2010

(65) Prior Publication Data

US 2010/0261368 A1 Oct. 14, 2010

Related U.S. Application Data

(60) Provisional application No. 61/169,050, filed on Apr. 14, 2009, provisional application No. 61/169,157, filed on Apr. 14, 2009.

(51) Int. Cl.
*H01R 4/50* (2006.01)

(52) U.S. Cl. ..... 439/772

(58) Field of Classification Search ..... 439/772, 439/761–771, 501, 806
See application file for complete search history.

(56) References Cited

U.S. PATENT DOCUMENTS

| | | | | |
|---|---|---|---|---|
| 2,493,389 | A * | 1/1950 | Casey | 439/762 |
| 5,468,159 | A * | 11/1995 | Brodsky et al. | 439/501 |
| 6,343,233 | B1 * | 1/2002 | Werner et al. | 607/119 |
| 7,749,030 | B1 * | 7/2010 | Smith | 439/772 |
| 2005/0202731 | A1 * | 9/2005 | Brito | 439/764 |

OTHER PUBLICATIONS

Halex Product Brochure 2008.

* cited by examiner

*Primary Examiner*—Chandrika Prasad
(74) *Attorney, Agent, or Firm*—Emerson Thomson & Bennett; Roger D. Emerson, Esq.

(57) ABSTRACT

A wire coupling device which may be used joining at least a separate first wire and second wire comprising: a housing having at least a first port and a second port, each port configured to receive a separate wire; a camming member disposed between the at least first and second ports, the camming member rotatable between a first, open position and a second, closed position, where the camming member provides electrical contact between the at least first wire and second wire when in the second, closed position.

18 Claims, 8 Drawing Sheets

WIRE COUPLING DEVICE WITH A CAM ACTUATED BY A LEVER

This application claims priority to U.S. Ser. No. 61/169,050, entitled WIRE COUPLING DEVICE, filed Apr. 14, 2009, which is incorporated herein by reference.

I. BACKGROUND

A. Field of Invention

This invention generally relates to methods and apparatuses concerning installation of utility lines and more specifically relates to methods and apparatuses concerning joining in electrical communication two or more separate lines.

B. Description of the Related Art

It is well known to utilize splicing and in-line wire couplings devices to join separate electrical wires or lines to provide electrical communication.

Known coupling devices may use bolts or set screws to secure the electrical lines. However, the splicing method requires use of specialized crimping tools, and the in-line methods require use of a standard wrench or a hex wrench. It is inconvenient for an electrician to carry additional crimping equipment or wrenches. Similarly, it is inefficient to stop the process of installing wire to join the separate wires together using a wrench.

What is needed is a wire coupling device that may be used to join wires together without the use of additional tools.

II. SUMMARY

According to one embodiment of this invention, a wire coupling assembly may comprise a housing that comprises: a first portion having at least one first port wherein the first port is closed on one end and includes an aperture on the opposite end having an interior passage, ending in a wire seating area, wherein the passage is sized to receive a first associated electrical wire and the first portion is made substantially from electrically non-conductive material; a second portion having at least one second port wherein the second port is closed on one end and includes an aperture on the opposite end having an interior passage, ending in a wire seating area, wherein the passage is sized to receive a second associated electrical wire and the second portion is made substantially from electrically non-conductive material, wherein the first portion and second portion are parallel and spaced apart in the same plane; a separating member that is joined in parallel to the first and second portions and acts to separate the first and second portions, wherein the separating member is made substantially from electrically non-conductive material; a camming mechanism disposed through the separating member and oriented perpendicular to the longitudinal axes of the first and second portions and the camming mechanism is made substantially from electrically conductive material wherein the camming mechanism is sized such that when the first and second associated electrical wires are inserted in the corresponding port passages, they are trapped between the camming mechanism and the port inner wall; a lever made substantially from electrically nonconductive material and operably attached to the camming mechanism; wherein the lever is rotationally adjustable with respect to the separating member between: (1) an open position where the lever is disposed at a first angle with respect to the separating member and there is no electrical contact between the first and second associated electrical; and, (2) a closed position where the lever is at a second angle which is substantially rotationally displaced relative to the first angle to provide electrical contact between the first and second associated electrical wires.

According to another embodiment of this invention, a wire coupling assembly may comprise housing that comprises a first portion having at least one first port wherein the first port is closed on one end and includes an aperture on the opposite end having an interior passage, ending in a wire seating area, wherein the passage is sized to receive electrical wire; the first portion has a groove on its open end which extends along its exterior perimeter perpendicular to its longitudinal axis and the first portion is made substantially from electrically non-conductive material; a second portion having at least one second port wherein the second port is closed on one end and includes an aperture on the opposite end having an interior passage, ending in a wire seating area, wherein the passage is sized to receive electrical wire wherein the first port and second port is parallel and spaced apart in the same plane; the second portion has a groove on its open end which extends along its exterior perimeter perpendicular to its longitudinal axis and the second portion is made substantially from electrically non-conductive material; a separating member that is joined in parallel to the first and second portions and acts to separate the first and second portions, wherein the separating member is made substantially from electrically non-conductive material; a camming mechanism disposed through the separating member and oriented perpendicular to the longitudinal axes of the first and second portions and the camming mechanism is made substantially from electrically conductive material wherein the camming mechanism is sized such that when an electrical wire is inserted in any the port passage, the electrical wire is trapped between the camming mechanism and the port inner wall; a lever made substantially from electrically nonconductive material and operably attached to the camming mechanism; wherein the lever is rotationally adjustable with respect to the separating member between: (1) an open position where the lever is disposed at a first angle with respect to the separating member; and, (2) a closed position where the lever is at a second angle which is substantially rotationally displaced relative to the first angle.

According to yet another embodiment of this invention a method of joining electrical wires may comprise the steps of: (A) providing a wire coupling assembly comprising: (1) a first portion having at least one first port wherein the first port is closed on one end and includes an aperture on the opposite end having an interior passage, ending in a wire seating area, wherein the passage is sized to receive a first associated electrical wire and the first portion is made substantially from electrically non-conductive material; (2) a second portion having at least one second port wherein the second port is closed on one end and includes an aperture on the opposite end having an interior passage, ending in a wire seating area, wherein the passage is sized to receive a second associated electrical wire and the second portion is made substantially from electrically non-conductive material, wherein the first portion and second portion is parallel and spaced apart in the same plane; a separating member that is be joined in parallel to the first and second portions and acts to separate the first and second portions, wherein the separating member is made substantially from electrically non-conductive material; a camming mechanism disposed through the separating member and oriented perpendicular to the longitudinal axes of the first and second portions and the camming mechanism is made substantially from electrically conductive material wherein the camming mechanism is sized such that when the first and second associated electrical wires are inserted in the corresponding port passages, they are trapped between the camming mechanism and the port inner wall; a lever made substantially from electrically nonconductive material and operably attached to the camming mechanism; wherein the lever is rotationally adjustable with respect to the separating member between: (1) an open position where the lever is disposed at a first angle with respect to the separating member and there is no electrical contact between the first and second associated electrical; and, (2) a closed position where the lever is at a second angle which is substantially rotationally displaced relative to the first angle to provide electrical contact between the first and second associated electrical wires; (B) with lever in the open position; (C) removing a portion of the insulation surrounding at least two electrical wires to be joined; (D) inserting the uninsulated ends of the electrical wires into first and second ports until the electrical wire ends come in contact with the wire seating areas; (E) rotating the lever from an open position to a closed position thereby engaging the camming member into each inserted electrical wire to provide electrical contact between the electrical wires and providing enough resistive force to prevent the inserted electrical wires from being withdrawn from wire coupling assembly.

One advantage of this invention is that for joining electrical wires it reduces the number of tools, and eliminates specialized tools that electricians need to carry.

Another advantage of this invention is that it provides an efficient method to join two or more separate electrical wires.

Yet another advantage of this invention is that it provides a simple to use and reliable device to join two or more separate electrical wires.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
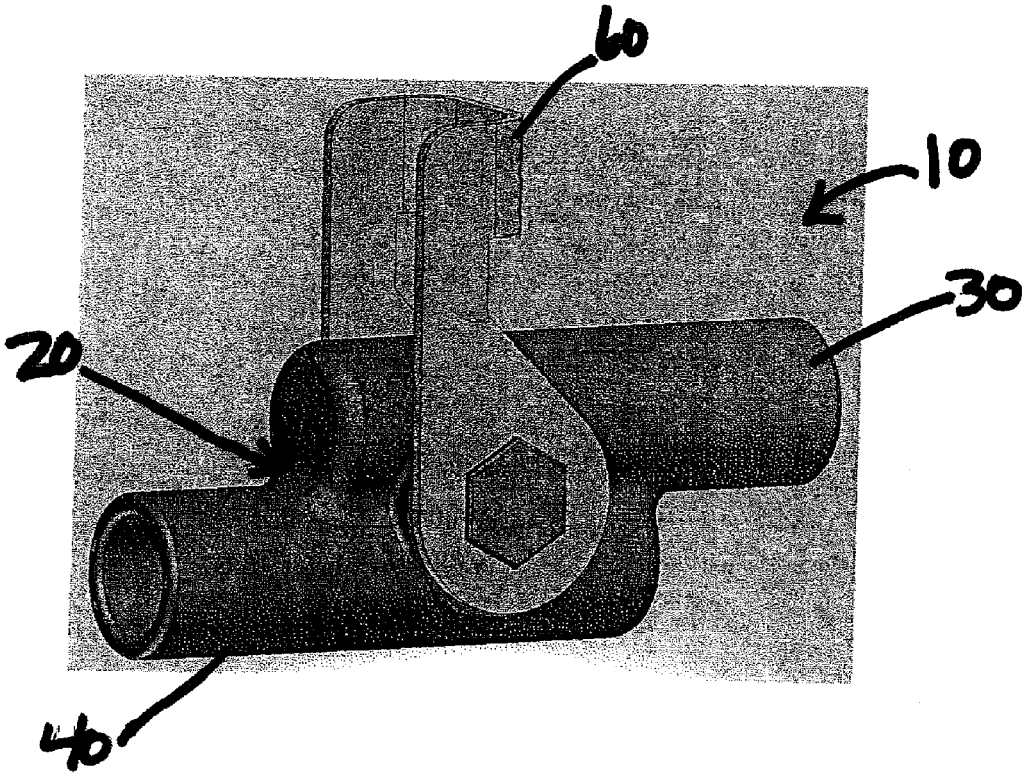
FIG. 1 is a perspective view of an exemplary embodiment of the wire coupling device of the present invention in an open first position.

Referring now to the drawings wherein the showings are for purposes of illustrating embodiments of the invention only and not for purposes of limiting the same, and wherein like reference numerals are understood to refer to like components, FIGS. 1-5 show a wire coupling device 10 that comprise a housing 20 which includes a first port 30 and a second port 40. In construction, the housing 20 may comprise a material that does not conduct electricity, or may have an interior that is insulated with non-conductive material. The longitudinal axes of ports 30, 40 may be parallel but spaced apart in the same plane and may be separated by a separating member 50. Of course, any other parallel or non-parallel arrangement may also be designed and utilized for particular desired situations. The device 10 may further include a lever 60 operably attached to a camming mechanism 70. The camming mechanism 70 may be disposed through the housing 20 and the separating member 50, and, such as in the arrangement shown in FIGS. 1-5, may be oriented perpendicular to the longitudinal axes of the ports 30, 40.

Figure 3:
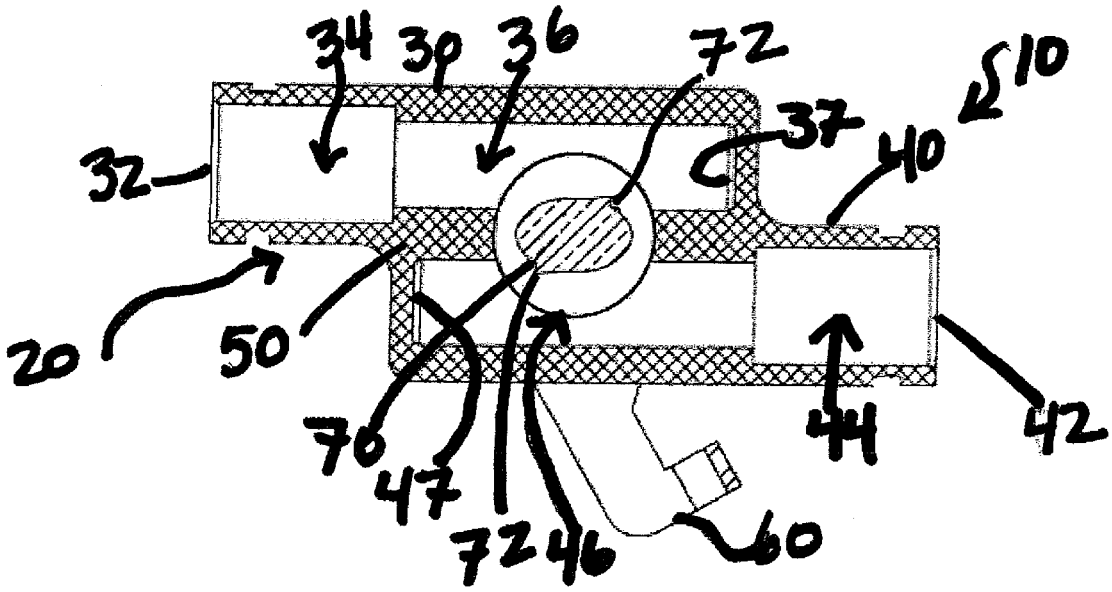
FIG. 3 is a cross-sectional view of the wire coupling device shown in FIG. 1 in the open first position.
Figure 4:
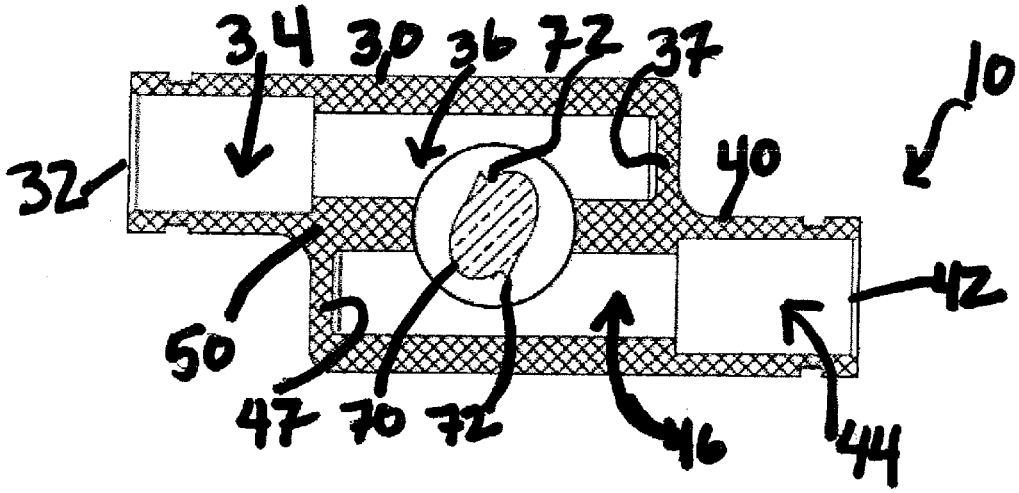
FIG. 4 is a cross-sectional view of the wire coupling device shown in FIG. 1 in the closed second position.

As shown in FIGS. 3-4, each port 30, 40 may include an aperture 32, 42 for receiving a wire. Each port 30, 40 may further include a first diameter 34, 44 and optionally a second diameter 36, 46. It is envisioned that additional combinations of diameters may be utilized, depending upon the type of wiring to be joined. For example, one size of device 10 may be designed to accommodate 250 MCM through #4 Al and Cu stranded wire, although device 10 and diameters 34, 44 and 36, 46 may be scaled to accommodate variously sized wires. In an alternate embodiment, diameter 34 may not be the same size as diameter 36, depending upon the combination of wires sought to be joined. Still further, it is contemplated that each port 30, 40 may only include a single diameter.

Figure 5:
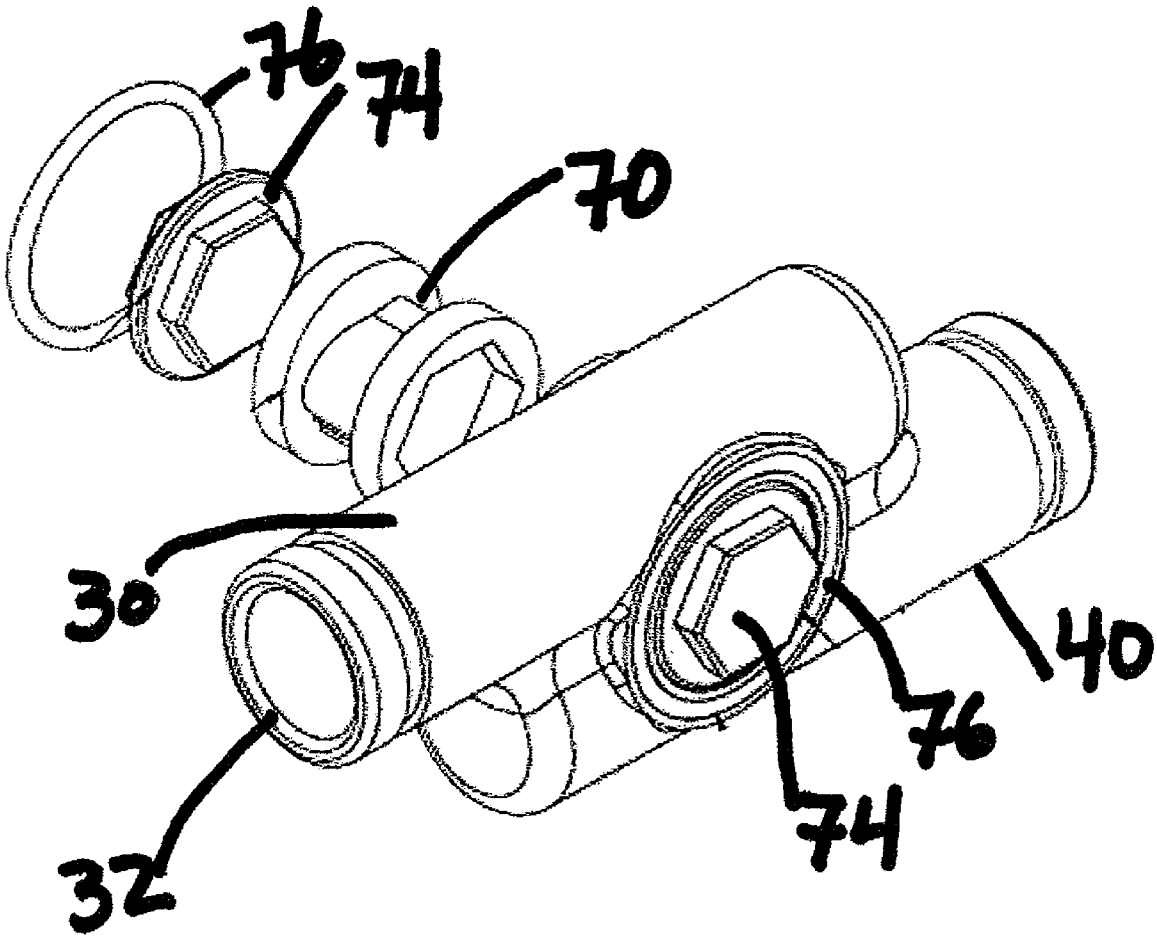
FIG. 5 is an exploded perspective view of the wire coupling device shown in FIG. 1.

Wire coupling device 10 may be used to join wires which are installed under ground, under water, or in other potentially moist environments. As moisture penetration into coupling device 10 may cause a "short" in the circuit in which the device is employed, precautions may be taken to reduce and/or eliminate moisture penetration. As shown in FIG. 5, couple device 10 may be assembled such that camming member 70 receives a nut 74, and any gap between nut 74 and housing 20 may be sealed by o-ring seal 76. It is envisioned that this camming member-nut-o-ring seal is present on each side of housing 20.

Figure 2:
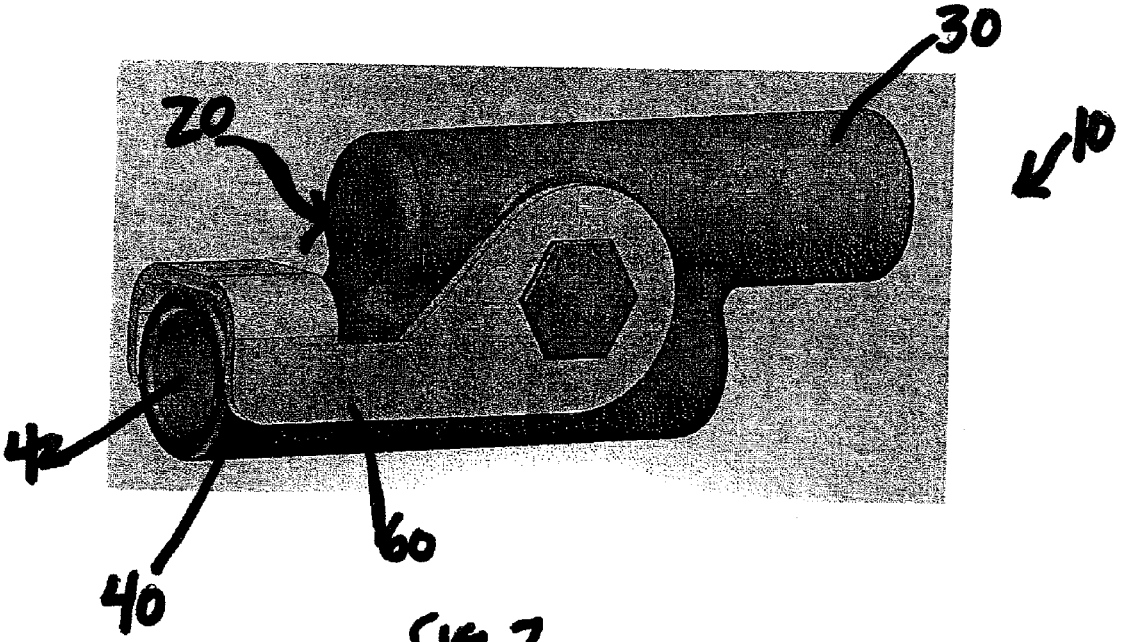
FIG. 2 is a perspective view of the wire coupling device show in FIG. 1 in a closed second position.

As shown in FIGS. 1-2, lever 60 may be attached to camming member 70, which may be formed from an electrically conductive material. It is envisioned that the conductive material may be a metal, such as bronze, although it is contemplated that camming member 70 may be formed from any other electrically conductive material. In one embodiment, camming member 70 may receive a nut 74 on each side, such that lever 60 may engage nut 74. Lever 60, and correspondingly camming member 70, may be rotatable between a first position and a second position, where the first position is an open position and the second position is a closed position. In particular embodiments, there may be 90° between the open first position and the closed second position. No matter the range of rotation, however, the lever 60 may be moved between the first and second positions using only a user's hand, without the need for additional tools to manipulate the lever.

As shown in FIGS. 3-4, the surface of camming member 70 may include teeth 72 or one or more edges designed to engage adjacent wires when camming member 70 is in the closed position. Camming member 70 may be sized such that when in the closed position, the inserted wire is pinched between the wall of each port 30, 40 and camming member 70 with sufficient pressure to provide sufficient frictional resistance upon the inserted wire to prevent the wire from withdrawing or being pulled from the coupling device 10. Furthermore, teeth 72 may provide additional mechanical resistance upon an inserted wire, thereby further preventing the inserted wire from withdrawing from ports 30, 40. However, should a user desire to remove a wire from the wire coupling device 10, lever 60 may be rotated from the close position to the open position, which disengages teeth 72 from the inserted wire and permits withdrawal of wires from the coupling device. In an alternate embodiment, it is envisioned that camming member 70 may not include teeth for additional mechanical resistance resistance upon an inserted wire.

In yet another alternative embodiment, generally illustrated in FIGS. 8*a*-8*d*, rather than a cam 70 and lever 60 configuration, the wire coupling device 10 utilizes spring steel blades 71, or other similar biased devices as known to persons of skill in the art, to capture and secure wires entering the coupling device in a single direction in much the same manner of operation employed in "Chinese finger cuffs".

When a user desires to join two or more wires together, the following method for using a wire coupling device may be followed. First, a wire coupling device 10 may be provided with the lever 60 in the open position. The user may then remove, or strip, the insulative sheath from the ends of each wire to be joined. The stripped end of one wire may be inserted into aperture 32, while the stripped end of the other wire may be inserted into aperture 42, until the ends of the stripped wire contact wire seats 37, 47. Next, lever 60 may be rotated from the open position to the closed position, thereby engaging teeth 72 into each of the inserted wires and providing mechanical resistance which may prevent the wires from withdrawing from the wire coupling device. As camming member 70 may be formed from an electrically conductive material, the stripped ends of the inserted wire are in electrical contact when the camming member 70 is in the closed position. Further, should a user desire to remove one or more wires from wire coupling device 10, lever 60 may be rotated from the closed position to the open position, thereby disengaging teeth 72 from the wire, relieving pressure between camming member 70 and walls 30, 40, and permitting withdrawal of the wire.

Alternatively, it is envisioned that the wires to be joined may not be stripped before being inserted into coupling device 10. As such, the surface camming member 70 may include one or more protrusions designed to pierce the insulative sheath of wire. The protrusions may comprise, or may be additional to, teeth 72 or one or more edges. Thus, the protrusions may contact the bare wire enclosed within the insulative sheath, thereby creating electrical contact between the inserted, but unstripped wires.

Figure 6:
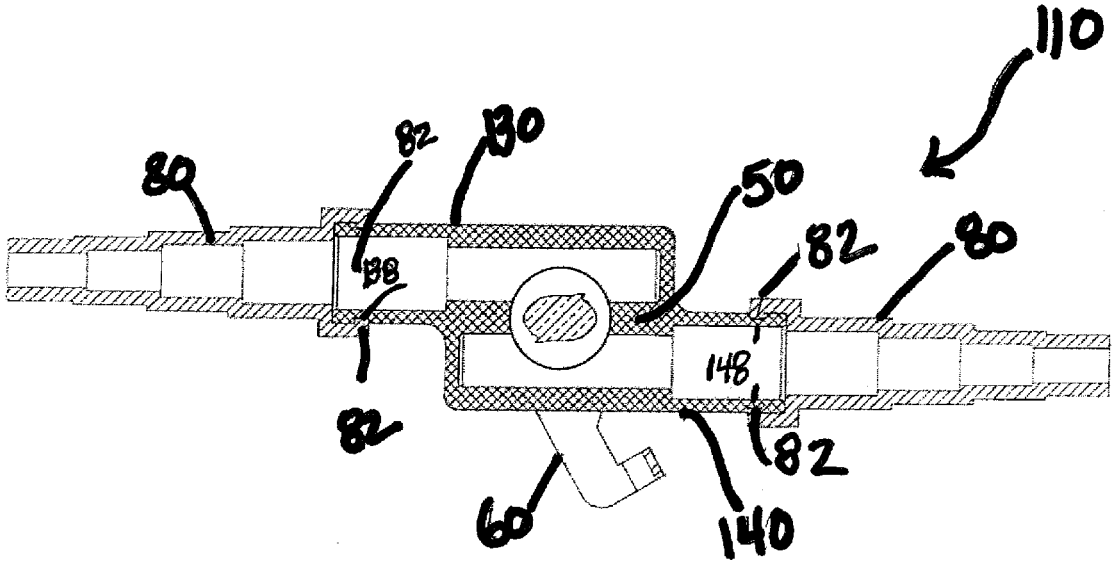
FIG. 6 is a cross-sectional view of an alternate embodiment of wire coupling device with boots attached thereto.

As indicated above, wire coupling devices may be installed in moisture-rich environments. One method for preventing moisture from entering a wire coupling device may be to cover each end of the device with a weatherproof boot commonly known in the art. In an embodiment shown in FIG. 6, wire coupling device 110 may comprise ports 130, 140, where the exterior surface of each port includes a depression 138, 148 for receiving a protruding ridge 82 on the interior diameter of a weatherproof boot 80. Thus, a boot 80 may be installed over a wire which is then inserted into the wire coupling device 110. One the wire has been locked into the device 110, the boot 80 may then be advanced along the wire until protruding ridge 82 engages the depression 138, 148 in the port 130, 140, thereby forming a water-tight seal.

Figure 7:
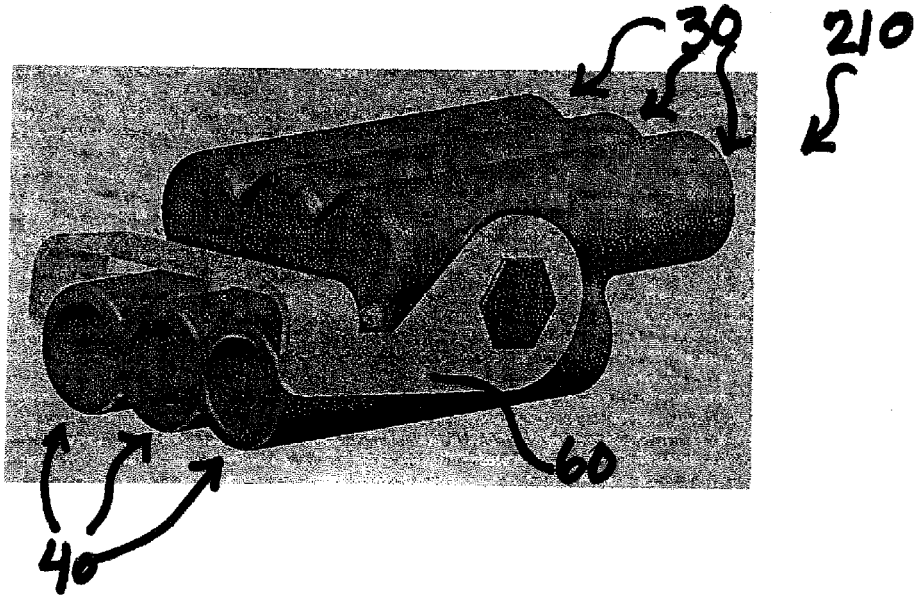
FIG. 7 is a perspective view of an alternate embodiment of a wire coupling device; and, FIGS. 8*a*-8*d* are perspective views of an alternative embodiment of a wire coupling device.
Figure 8A:
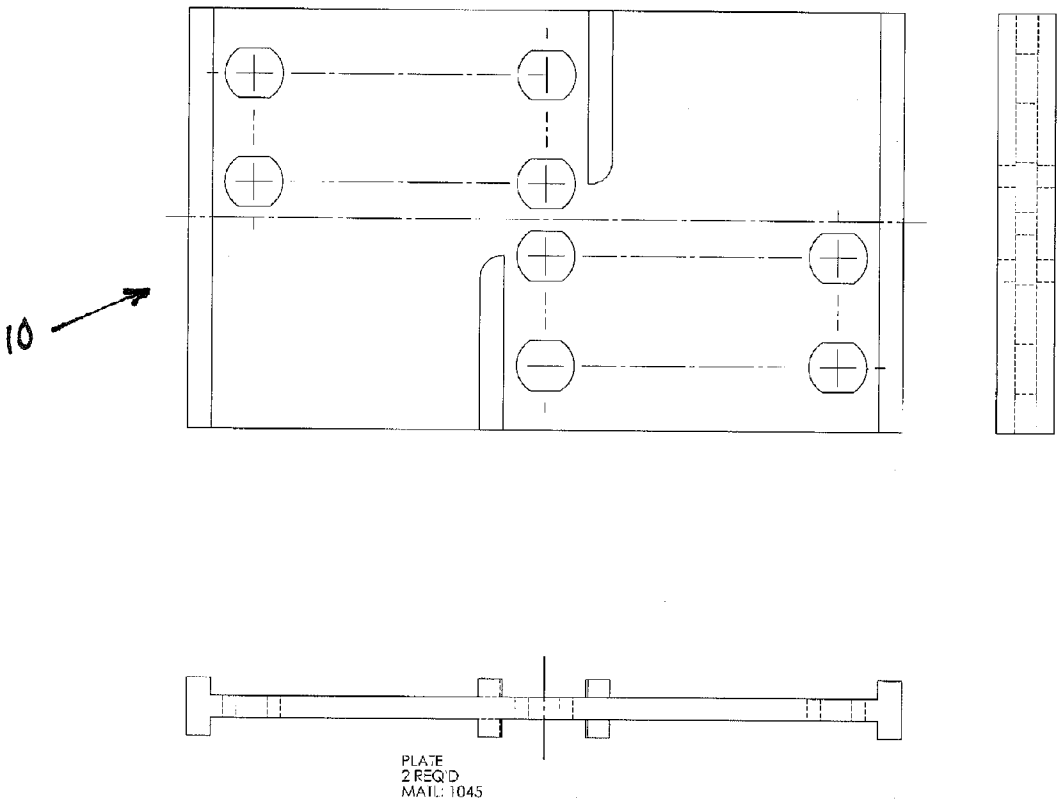
Figure 8A:
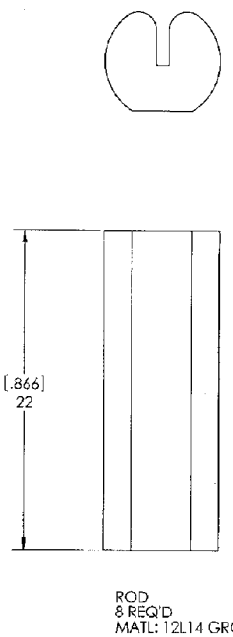
Figure 8B:
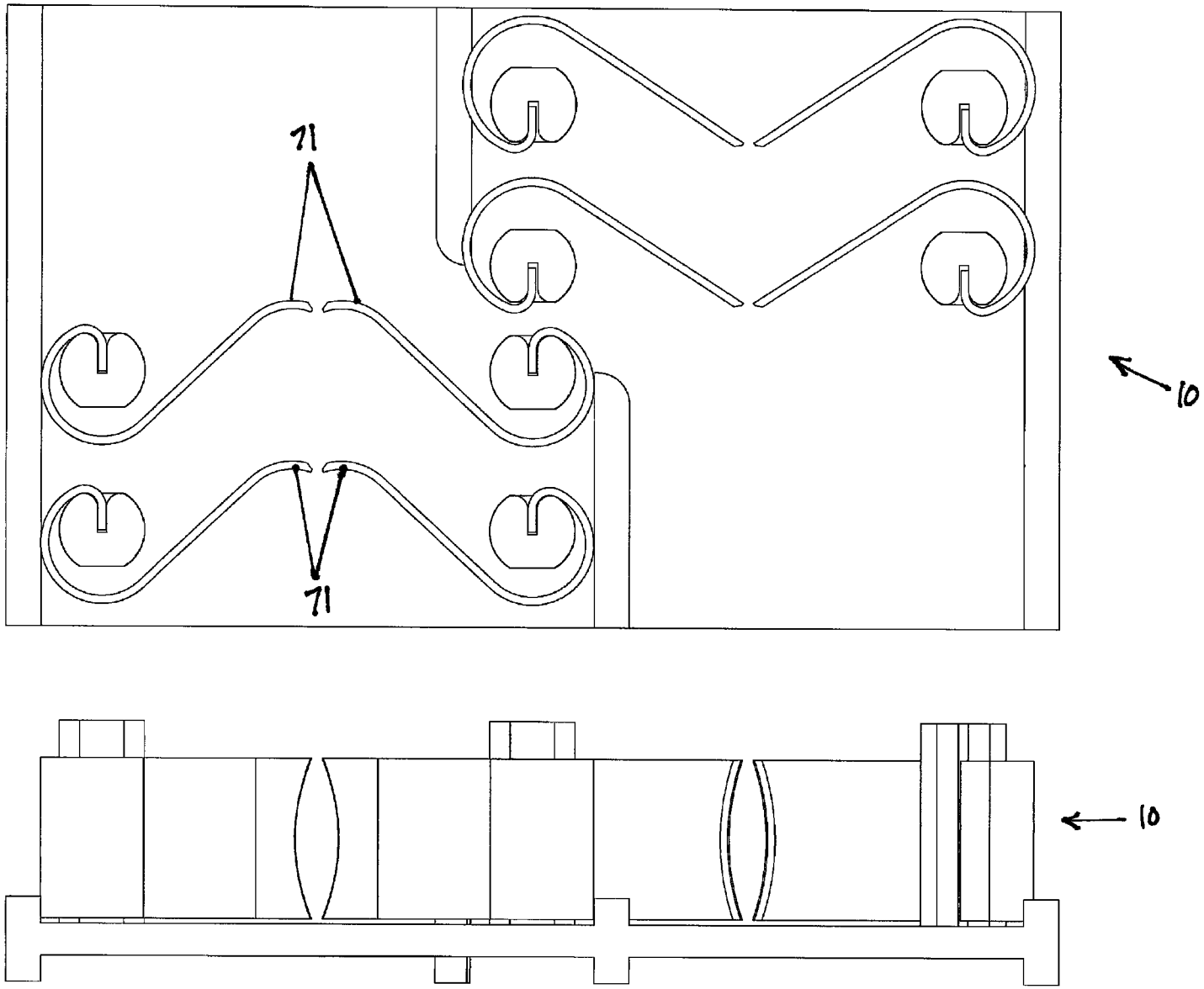
Figure 8C:
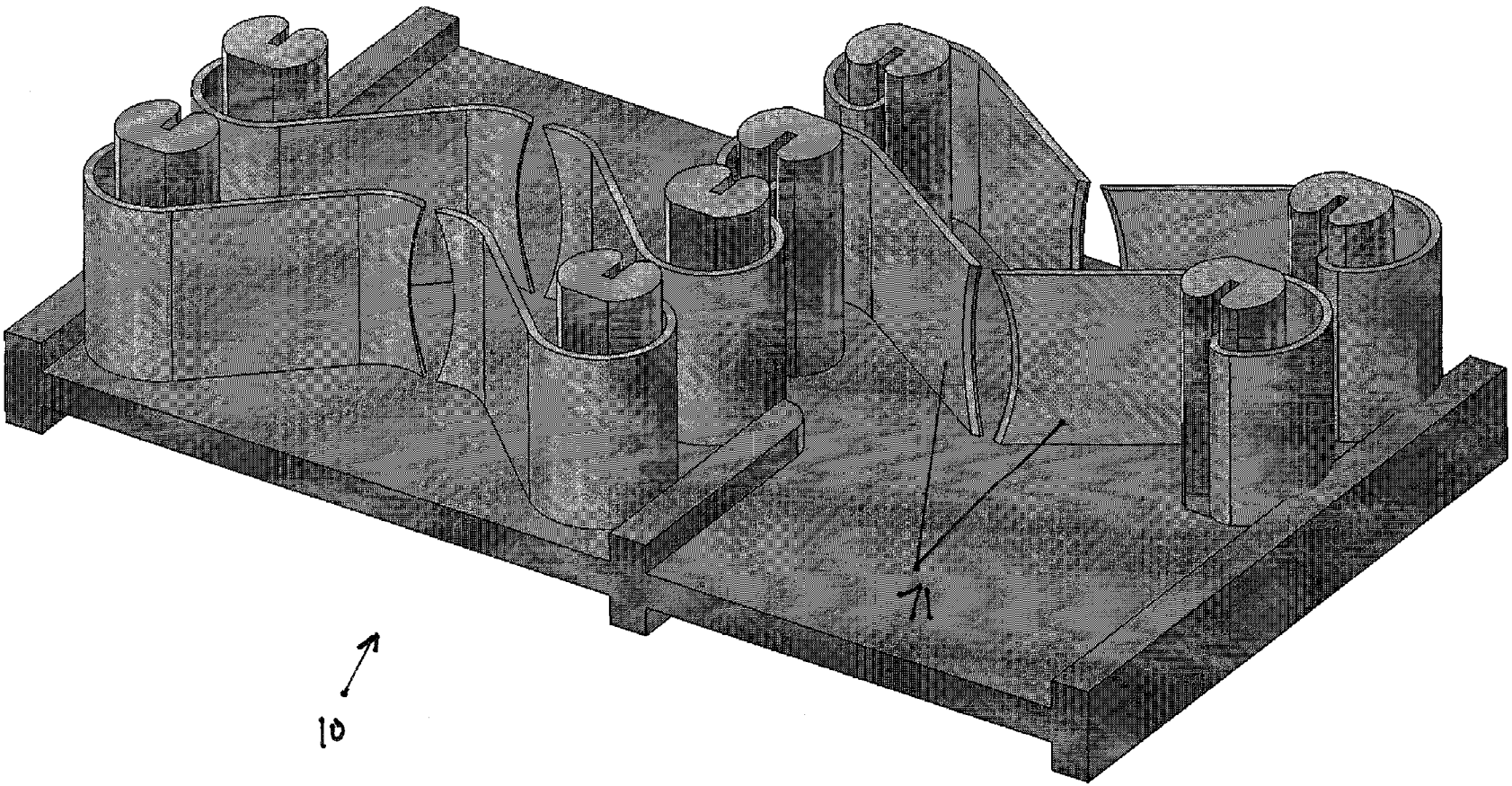
Figure 8D:
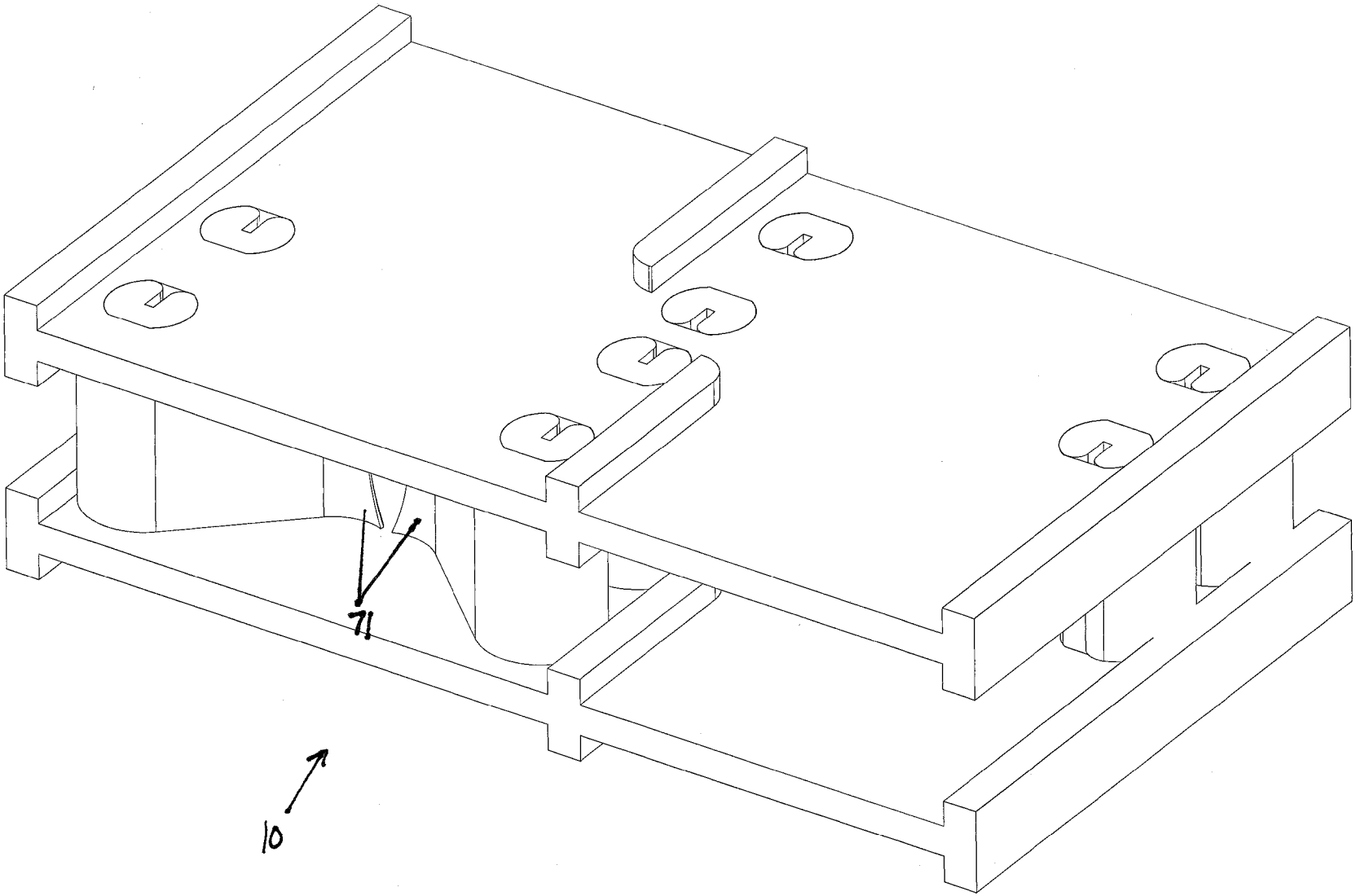

In a further embodiment shown in FIG. 7, a wire coupling device 210 may including a plurality of ports 30, 40 for instances where there is a desire to join multiple wires at a single location using a single wire coupling devices. In yet another alternate embodiment, it is envisioned that the camming member may span at least two ports on one end of a wire coupling device, yet only a single port may be in contact with the two ports on the other end of the device. As such, it may be possible to join two or wires on one end of the wire coupling device to only one wire on the other end of the wire coupling device.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. A wire coupling assembly comprising:

A housing comprising:

A first portion having at least one first port wherein the first port is closed on one end and includes an aperture on the opposite end having an interior passage, ending in a wire seating area, wherein the passage is sized to receive a first associated electrical wire and the first portion is made substantially from electrically non-conductive material;

a second portion having at least one second port wherein the second port is closed on one end and includes an aperture on the opposite end having an interior passage, ending in a wire seating area, wherein the passage is sized to receive a second associated electrical wire and the second portion is made substantially from electrically non-conductive material, wherein the first portion and second portion are parallel and spaced apart in the same plane;

a separating member that is joined in parallel to the first and second portions and acts to separate the first and second portions wherein the separating member is made substantially from electrically non-conductive material;

a camming mechanism disposed through the separating member and oriented perpendicular to the longitudinal axes of the first and second portions and the camming mechanism is made substantially from electrically conductive material wherein the camming mechanism is sized such that when the first and second associated electrical wires are inserted in the corresponding port passages, they are trapped between the camming mechanism and the port inner wall;

a lever made substantially from electrically nonconductive material and operably attached to the camming mechanism;

wherein the lever is rotationally adjustable with respect to the separating member between:

(1) an open position where the lever is disposed at a first angle with respect to the separating member and there is no electrical contact between the first and second associated electrical; and, (2) a closed position where the lever is at a second angle which is substantially rotationally displaced relative to the first angle to provide electrical contact between the first and second associated electrical wires.

2. The wire coupling assembly of claim 1 further comprising:

One or more edges extend from the outer surface of the camming mechanism and are used to engage electrical wires when the camming mechanism is in the closed position and the edges disengage wire when the camming mechanism is in the open position.

3. The wire coupling assembly of claim 2 wherein:

the edges are configured to pierce the insulation surrounding electrical wire.

4. The wire coupling assembly of claim 1 wherein:
the camming mechanism is formed out of bronze.

5. The wire coupling assembly of claim 1 wherein:
the first port passage comprises a first section with a first cross sectional area and a second section with a second cross sectional area.

6. The wire coupling assembly of claim 1 wherein:
the second port passage comprises a first section with a first cross sectional area and a second section with a second cross sectional area.

7. The wire coupling assembly of claim 1 wherein:
the port passages are sized to receive 250 MCM electrical wire.

8. The wire coupling assembly of claim 1 wherein:
the port passages are sized to receive #4 aluminum and copper stranded electrical wire.

9. The wire coupling assembly of claim 1 wherein:
when the lever is in the open position the lever makes a substantially 90 degree angle with respect to the separating member; and when the lever is in the closed position the lever makes a substantially 0 degree angle with respect to the separating member.

10. The wire coupling assembly of claim 1 further comprising:
A first threaded section on one end of the camming member;
a second threaded section on the opposite end of the camming member; and,
a first nut and second nut formed with threads to mate with the camming member wherein the first and second nuts engage the camming member and the lever.

11. The wire coupling assembly of claim 10 further comprising:
a first sealing member and second sealing member wherein the sealing members are sized to be inserted over the threaded sections of the camming member and positioned between the camming member and the nuts wherein the sealing member and the nut is used to reduce the penetration of moisture into the port passages.

12. The wire coupling assembly of claim 11 wherein:
the sealing member is an o-ring.

13. The wire coupling assembly of claim 1 wherein:
the first portion is made substantially from electrically conductive material and interior surface of the first port passages is insulated with a non-conductive material; and,
the second portion is made substantially from electrically conductive material and interior surface of the second port passages are insulated with a non-conductive material.

14. The wire coupling assembly of claim 1 wherein:
the first portion has one first port; and,
the second portion has more than one second port.

15. The wire coupling assembly of claim 1 wherein:
the first portion has more than one first port; and,
the second portion has more than one second port.

16. A wire coupling assembly comprising:
A housing comprising:
a first portion having at least one first port wherein the first port is closed on one end and include an aperture on the opposite end having a interior passage, ending in a wire seating area wherein the passage is sized to receive electrical wire;
the first portion has a groove on its open end which extends along its exterior perimeter perpendicular to its longitudinal axis and the first portion is made substantially from electrically non-conductive material;
a second portion having at least a one second ports wherein the second port is closed on one end and include an aperture on the opposite end having an interior passage, ending in a wire seating area, wherein the passage is sized to receive electrical wire wherein the first port and second port is parallel and spaced apart in the same plane;
the second portion has a groove on its open end which extends along its exterior perimeter perpendicular to its longitudinal axis and the second portion is made substantially from electrically non-conductive material;
a separating member that is joined in parallel to the first and second portions and acts to separate the first and second portions, wherein the separating member is made substantially from electrically non-conductive material;
a camming mechanism disposed through the separating member and oriented perpendicular to the longitudinal axes of the first and second portions and the camming mechanism is made substantially from electrically conductive material wherein the camming mechanism is sized such that when an electrical wire is inserted in any the port passage, the electrical wire is trapped between the camming mechanism and the port inner wall; and,
a lever made substantially from electrically nonconductive material and operably attached to the camming mechanism;
wherein the lever is rotationally adjustable with respect to the separating member between:
(1) an open position where the lever is disposed at a first angle with respect to the separating member; and, (2) a closed position where the lever is at a second angle which is substantially rotationally displaced relative to the first angle.

17. The wire coupling assembly of claim 16 further comprising:
a pair of weatherproof boots inserted over first and second portions.

18. A method of joining electrical wires comprising the steps of:
(A) providing a wire coupling assembly comprising: (1) a first portion having at least one first port wherein the first port is be closed on one end and include an aperture on the opposite end having a interior passage, ending in a wire seating area, wherein the passage is be sized to receive a first associated electrical wire and the first portion is made substantially from electrically non-conductive material; (2) a second portion having at least a one second ports wherein the second port is closed on one end and include an aperture on the opposite end having a interior passage, ending in a wire seating area, wherein the passage is sized to receive a second associated electrical wire and the second portion is made substantially from electrically non-conductive material, wherein the first portion and second portion is parallel and spaced apart in the same plane; a separating member that is be joined in parallel to the first and second portions and acts to separate the first and second portions, wherein the separating member is made substantially from electrically non-conductive material; a camming mechanism disposed through the separating member and oriented perpendicular to the longitudinal axes of the first and second portions and the camming mechanism is made substantially from electrically conductive material wherein the camming mechanism is sized such that when the first and second associated electrical wire is inserted in the corresponding port passages, they are trapped between the camming mechanism and the port inner wall; and a lever made substantially from electrically nonconductive material and operably attached to the camming mechanism; wherein the lever is rotationally adjustable with respect to the separating member between: (1) an open position where the lever is disposed at a first angle with respect to the separating member and there is no electrical contact between the first and second associated electrical; and, (2) a closed position where the lever is at a second angle which is substantially rotationally displaced relative to the first angle to provide electrical contact between the first and second associated electrical wires;

(B) with lever in the open position;

(C) removing a portion of the insulation surrounding at least two electrical wires to be joined;

(D) inserting the uninsulated ends of the electrical wires into first and second ports until the electrical wire ends come in contact with the wire seating areas; and, (E) rotating the lever from an open position to a closed position thereby engaging the camming member into each inserted electrical wire to provide electrical contact between the electrical wires and providing enough resistive force to prevent the inserted electrical wires from being withdrawn from wire coupling assembly.

* * * * *